US012460858B2

(12) United States Patent
Gibson et al.

(10) Patent No.: US 12,460,858 B2
(45) Date of Patent: Nov. 4, 2025

(54) SNAP FIT ATTACHMENT FEATURE FOR A MULLION ASSEMBLY OF A REFRIGERATOR APPLIANCE

(71) Applicant: Haier US Appliance Solutions, Inc., Wilmington, DE (US)

(72) Inventors: James Gibson, Louisville, KY (US); Gopi Krishna Vulava, Louisville, KY (US); Matthew Davis, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 275 days.

(21) Appl. No.: 18/349,876

(22) Filed: Jul. 10, 2023

(65) Prior Publication Data

US 2025/0020391 A1 Jan. 16, 2025

(51) Int. Cl.
*F25D 23/06* (2006.01)

(52) U.S. Cl.
CPC ..... *F25D 23/065* (2013.01); *F25D 23/063* (2013.01); *F25D 2400/04* (2013.01)

(58) Field of Classification Search
CPC .... F25D 23/065; F25D 23/066; F25D 23/067; F25D 23/069; F25D 2323/06; F25D 2400/04
See application file for complete search history.

(56) References Cited

U.S. PATENT DOCUMENTS

| | | | | | |
|---|---|---|---|---|---|
| 4,170,391 | A | | 10/1979 | Bottger | |
| 4,550,576 | A | * | 11/1985 | Tate, Jr. | F25D 23/069 62/447 |
| 4,862,577 | A | * | 9/1989 | Cordill | F25D 23/067 29/897.3 |
| 4,955,676 | A | * | 9/1990 | Weaver | F25D 23/069 312/236 |
| 5,255,531 | A | * | 10/1993 | Williams | F25D 23/028 62/277 |
| 5,897,181 | A | * | 4/1999 | Avendano | F25D 23/062 312/401 |
| 5,992,960 | A | * | 11/1999 | Wolanin | F25D 21/04 312/265.5 |
| 7,407,240 | B2 | | 8/2008 | Collins et al. | |
| 10,215,471 | B2 | * | 2/2019 | Grimm | F25D 21/04 |
| 2005/0017618 | A1 | * | 1/2005 | Myers | F25D 23/066 312/406 |
| 2006/0152126 | A1 | * | 7/2006 | Collins | F25D 23/069 312/407 |
| 2006/0267468 | A1 | * | 11/2006 | Myers | F25D 23/066 312/406 |
| 2018/0073798 | A1 | * | 3/2018 | Bajak | F25D 23/064 |

(Continued)

*Primary Examiner* — Daniel J Rohrhoff
(74) *Attorney, Agent, or Firm* — Dority & Manning, P.A.

(57) ABSTRACT

A refrigerator appliance may include a case body that defines a front end. The case body may include a front lip positioned at the front end. The refrigerator appliance may also include a mullion assembly. The mullion assembly may include a cosmetic mullion. The cosmetic mullion may include a flange and a main body. The flange of the cosmetic mullion may include an outer bent rib. The mullion assembly may also include a stiffener. The stiffener may include a flange and a main body. The mullion assembly may further include a mullion clip. The mullion clip may include an inner bent rib and a lance bridge.

19 Claims, 13 Drawing Sheets

(56) References Cited

U.S. PATENT DOCUMENTS

| | | | | |
|---|---|---|---|---|
| 2021/0222944 | A1* | 7/2021 | Harikrishnasamy | F25D 23/067 |
| 2023/0014666 | A1* | 1/2023 | Huang | F25D 23/067 |
| 2023/0130833 | A1* | 4/2023 | Thomas | F25D 21/04 62/440 |

* cited by examiner

SNAP FIT ATTACHMENT FEATURE FOR A MULLION ASSEMBLY OF A REFRIGERATOR APPLIANCE

FIELD

The present subject matter relates generally to refrigerator appliances, and more particularly to a snap fit attachment feature for a mullion assembly of a refrigerator appliance.

BACKGROUND

Refrigerator appliances often include a cabinet that defines one or more chilled chambers configured to hold articles, such as food items, therein. For example, the cabinet of the refrigerator appliance may define a fresh food chamber and a freezer chamber. In some models and styles of refrigerator appliances, these chambers are stacked vertically, for example, in a French door style refrigerator appliance. Often such refrigerator appliance may include a mullion assembly that is extended horizontally across the cabinet. The horizontal mullion assembly separates the one or more chilled chambers, for example, separates the fresh food chamber and the freezer chamber.

Fasteners may commonly be used to attach the mullion assembly to the cabinet. However, using fasteners to attach the mullion assembly to the cabinet may have drawbacks. For instance, the use of fasteners may increase the cost of manufacturing, may decrease ergonomics during the assembly process, and may introduce waste during the assembly process, for example, when fasteners are misaligned.

Accordingly, an improved attachment feature for a mullion assembly that may be used to attach the mullion assembly to the cabinet of the refrigerator appliance without the need for fasteners is desired. More specifically, a refrigerator appliance that includes features that physically locate the mullion assembly to the cabinet and snap-fit features that attach the mullion assembly to the cabinet would be particularly beneficial.

BRIEF DESCRIPTION

Aspects and advantages of the invention will be set forth in part in the following description, or may be apparent from the description, or may be learned through practice of the invention.

In one exemplary embodiment, a refrigerator appliance is provided. The refrigerator appliance may define a vertical direction, a lateral direction, and a transverse direction. The refrigerator appliance may include a case body. The case body may include a first front lip and a second front lip. The first front lip and the second front lip may be spaced apart approximately along the lateral direction. The refrigerator appliance may also include a mullion assembly attached to the case body. The mullion assembly may be extended from a first end to a second end approximately along the lateral direction. The mullion assembly may include a first flange assembly positioned at the first end. The first flange assembly may be attached to the first front lip by a snap fit. The mullion assembly may also include a second flange assembly positioned at the second end of the mullion assembly. The second flange assembly may be attached to the second front lip by a snap fit.

In another exemplary embodiment, a refrigerator appliance is provided. The refrigerator appliance may include a case body that may define a front end. The case body may include a front lip positioned at the front end. The refrigerator appliance may also include a mullion assembly. The mullion assembly may include a cosmetic mullion. The cosmetic mullion may include a flange and a main body. The flange of the cosmetic mullion may include an outer bent rib. The mullion assembly may also include a stiffener. The stiffener may include a flange and a main body. The mullion assembly may further include a mullion clip. The mullion clip may include an inner bent rib and a lance bridge. The flange of the cosmetic mullion may be attached to the flange of the stiffener. The mullion clip may be attached to the flange of the stiffener. The flange of the cosmetic mullion, the flange of the stiffener, and the mullion clip together may form a flange assembly. The flange assembly may be attached to the front lip of the case body by a snap fit.

In yet another exemplary embodiment, a refrigerator appliance is provided. The refrigerator appliance may include a case body that may define a front end. The case body may include a front lip positioned at the front end. The mullion assembly may include a cosmetic mullion. The cosmetic mullion may include a flange and a main body. The flange of the cosmetic mulling may include an outer bent rib. The mullion assembly may further include a stiffener. The stiffener may include a flange and a main body. The flange of the stiffener may include a first portion and a second portion. The second portion of the flange may include an inner bent rib and a lance bridge. The flange of the cosmetic mullion is attached to the flange of the stiffener. The flange of the cosmetic mullion and the flange of the stiffener may together form a flange assembly. The flange assembly may be attached to the front lip of the case body by a snap fit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
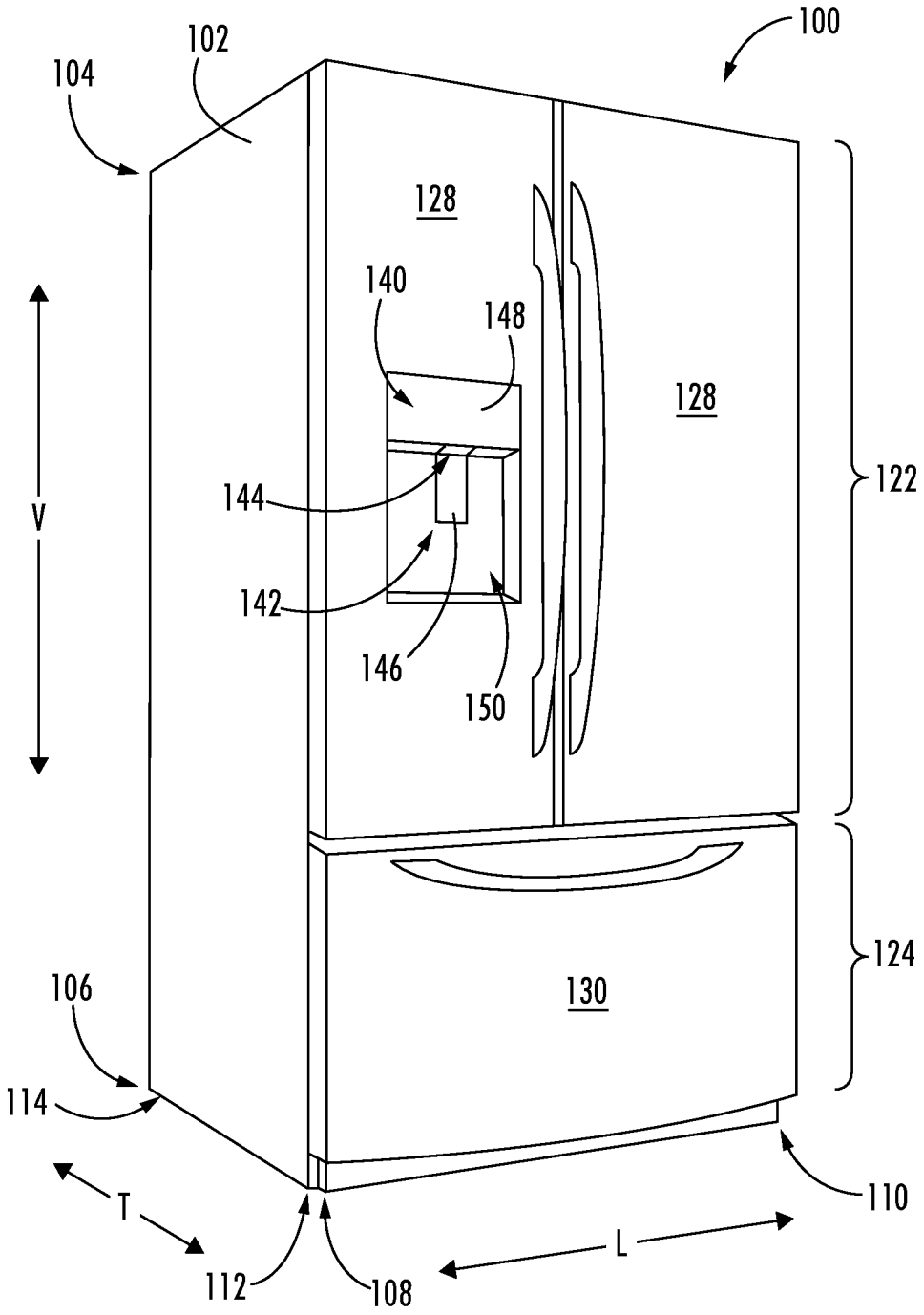
FIG. 1 provides a perspective view of a refrigerator appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
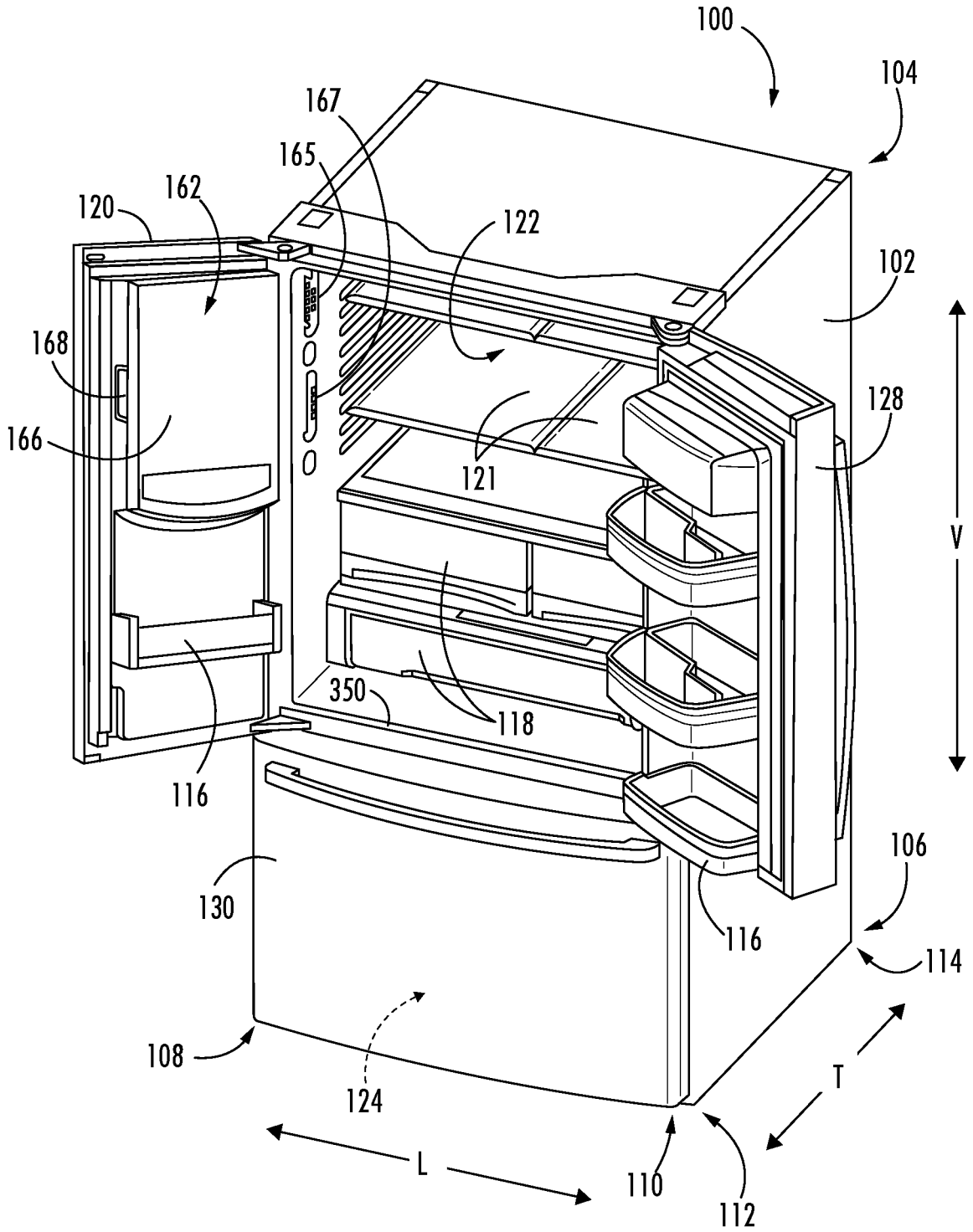
FIG. 2 provides an additional perspective view of the refrigerator appliance of FIG. 1 with doors of the refrigerator appliance in an open position.

Referring now to the figures, FIGS. 1 and 2 provide perspective views of a refrigerator appliance 100 according to one or more exemplary embodiments of the present subject matter. The refrigerator appliance may define a vertical direction V, a lateral direction L, and a transverse direction T. The vertical direction V, the lateral direction L, and the transverse direction T may each be mutually perpendicular to one another to generally form an orthogonal coordinate system.

As illustrated in FIGS. 1 and 2, the refrigerator appliance 100 may include a housing or a cabinet 102 that may extend between a top 104 and a bottom 106 approximately along a vertical direction V, between a first side 108 and a second side 110 approximately along a lateral direction L, and between a front 112 and a back 114 approximately along a transverse direction T. The cabinet 102 may define one or more chilled chambers for receipt of food items for storage. In some embodiments, the cabinet 102 may define a fresh food chamber 122 positioned at or adjacent the top 104 of the cabinet 102 and a freezer chamber 124 arranged at or adjacent the bottom 106 of the cabinet 102. As such, the refrigerator appliance 100 may generally be referred to as a bottom mount refrigerator.

It is recognized, however, that the benefits of the present disclosure apply to other types and styles of refrigerator appliances such as, for example, a top mount refrigerator appliance. Consequently, the description set forth herein is for illustrative purposes only and is not intended to be limiting in any aspect to any particular refrigerator chamber configuration.

The refrigerator doors 128 may be rotatably hinged to an edge of the cabinet 102 for selectively accessing the fresh food chamber 122. In addition, a freezer door 130 may be arranged below the refrigerator doors 128 for selectively accessing the freezer chamber 124. The freezer door 130 may be coupled to a freezer drawer (not shown) slidably mounted within the freezer chamber 124. The refrigerator doors 128 and the freezer door 130 may be shown in the closed configuration in FIG. 1.

In some embodiments, various storage components may be mounted within the fresh food chamber 122 to facilitate storage of food items therein. In particular, the storage components may include storage bins 116, drawers 118, and shelves 121 that may be mounted within the fresh food chamber 122. As such, the storage bins 116, drawers 118, and shelves 121 are configured for receipt of food items, for example, beverages or solid food items, and may assist with organizing such food items. As an example, the drawers 184 can receive fresh food items, for example, vegetables, fruits, or cheeses, and increase the useful life of such fresh food items.

In some embodiments, the refrigerator appliance 100 may also include a dispensing assembly 140 for dispensing liquid water or ice. The dispensing assembly 140 may include a dispenser 142, for example, positioned on or mounted to an exterior portion of the refrigerator appliance 100, such as on one of the refrigerator doors 128. Moreover, as shown in FIG. 1, the dispenser 142 may include a discharging outlet 144 for accessing ice and liquid water. Further, an actuating mechanism 146, shown as a paddle, may be mounted below the discharging outlet 144 for operating the dispenser 142. In alternative embodiments, any suitable actuating mechanism may be used to operate the dispenser 142. A user interface panel 148 may also be provided for controlling the mode of operation. For example, the user interface panel 148 may include a plurality of user inputs (not labeled), such as a water dispensing button and an ice-dispensing button, for selecting a desired mode of operation such as crushed or non-crushed ice.

Still referring to FIG. 1, the discharging outlet 144 and actuating mechanism 146 may be an external part of the dispenser 142 and may be mounted in a dispenser recess 150. The dispenser recess 150 may be positioned at a predetermined elevation convenient for a user to access ice or water and enabling the user to access ice without the need to bend-over and without the need to open the refrigerator doors 128. In additional embodiments, the dispenser recess 150 may be positioned at a level that approximates the chest level of a user.

In further embodiments, for example, as shown in FIG. 2, the refrigerator appliance 100 may include a sub-compartment 162 defined on the refrigerator door 128. The sub-compartment 162 is often referred to as an "icebox." Further, the sub-compartment 162 may extend into fresh food chamber 122 when the refrigerator door 128 is in the closed position. Although the sub-compartment 162 is shown in the refrigerator door 128, additional or alternative embodiments may include the sub-compartment 162 fixed within fresh food chamber 122. In an embodiment, an ice maker and/or an ice storage bin (not shown) may be positioned or disposed within the sub-compartment 162. Accordingly, during use, ice can be supplied to the dispenser recess 150, see, for example, FIG. 1, from the ice making assembly or ice storage bin in the sub-compartment 162 on a back side of refrigerator door 128.

In additional or alternative embodiments, chilled air from a sealed system (not shown) of the refrigerator appliance 100 may be directed into components within the sub-compartment 162. For instance, the sub-compartment 162 may receive cooling air from a chilled air supply duct 165 and a chilled air return duct 167, see, for example, FIG. 2, disposed on a side portion of cabinet 102 of the refrigerator appliance 100. In this manner, the chilled air supply duct 165 and the chilled air return duct 167 may recirculate chilled air from a suitable sealed cooling system through the sub-compartment 162.

In optional embodiments, for example, as illustrated in FIG. 2, an access door 166 may be hinged to the refrigerator door 128. Thus, the access door 166 may permit selective access to the sub-compartment 162. Any manner of suitable latch 168 may be configured with the sub-compartment 162 to maintain the access door 166 in a closed position. As an example, the latch 168 may be actuated by a user in order to open the access door 166 for providing access into the sub-compartment 162. The access door 166 can also assist with insulating the sub-compartment 162 (e.g., by thermally isolating or insulating the sub-compartment 162 from the fresh food chamber 122). It is noted that although the access door 166 is illustrated in exemplary embodiments, alternative embodiments may be free of any separate access door.

In some embodiments, the refrigerator appliance 100 may include a mullion assembly 350 that may extend horizontally, for example, approximately along or approximately parallel to the lateral direction L, across the cabinet 102 to divide the various chambers of refrigerator appliance 100 and/or prevent leakage therefrom. Particularly, the mullion assembly 350 may be disposed between and separating fresh food chamber 122 and freezer chamber 124.

One of ordinary skill in the art would understand that only one mullion assembly 350 is generally illustrated and described herein. However, in additional or alternative embodiments, a refrigerator appliance may include more than one mullion assembly 350. For example, in some embodiments, a refrigerator appliance may include a second mullion assembly that may separate a first freezer chamber and a second freezer chamber of the refrigerator appliance.

Figure 3:
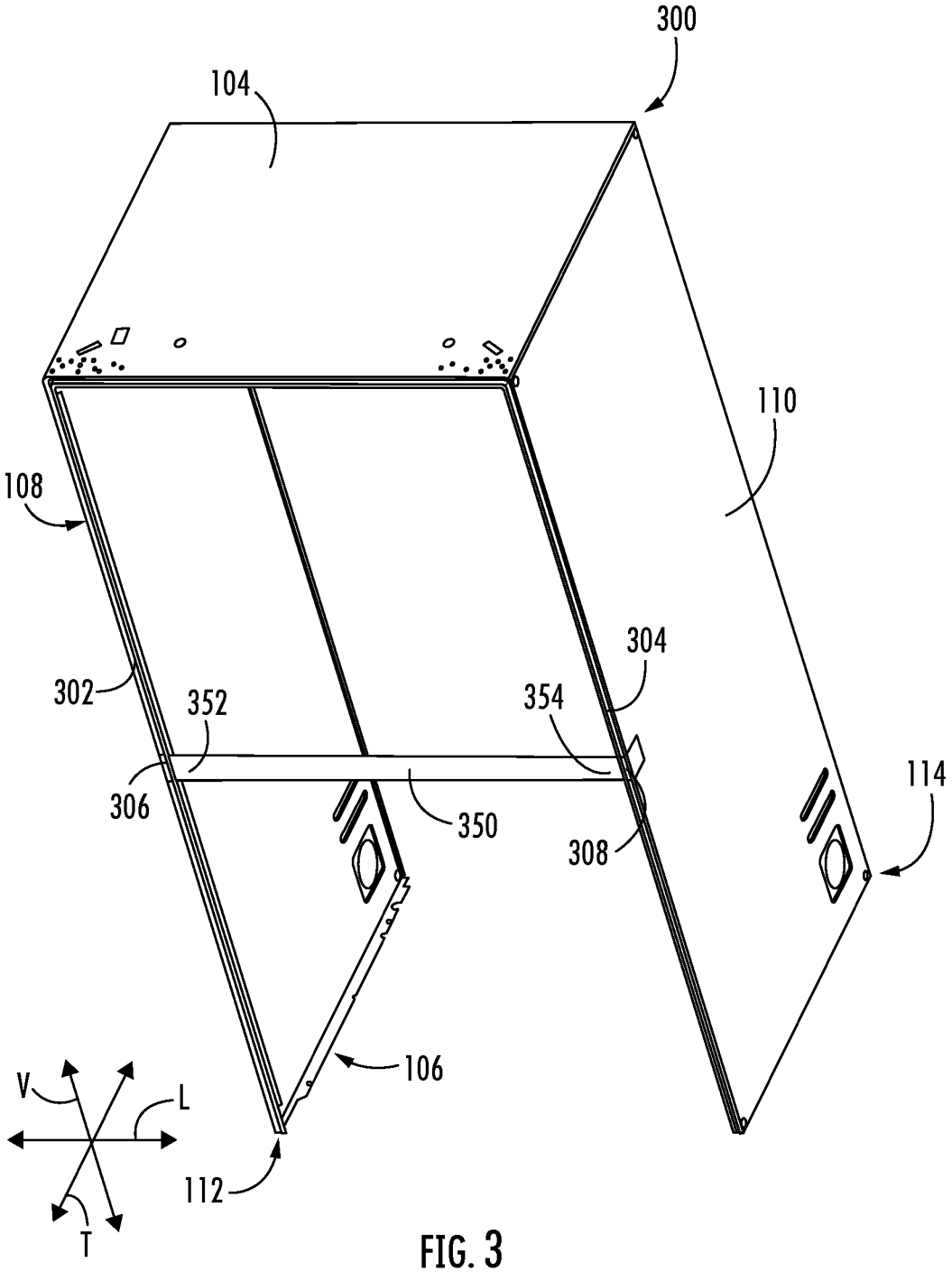
FIG. 3 provides a perspective view of a case body of the refrigerator appliance of FIG. 1 according to one or more exemplary embodiments of the present subject matter.

Referring now to FIG. 3, a case body 300 according to one or more exemplary embodiments of the present subject matter is provided. In some embodiments, the case body 300 may be a portion of the cabinet 120. For instance, in some embodiments, the case body 300 may be formed into a "U" shape from a piece of sheet metal to provide the top 104, the first side 108, and the second side 110 of the cabinet 120. In addition, the case body 300 may extend approximately along the transverse direction T to define the front 112 and the back 114 of the refrigerator appliance 100. Moreover, in some embodiments, the case body 300 may include a front lip positioned at the front 112 of the case body 300. Particularly, the front lip may include a first front lip 302 and a second front lip 304. The first front lip 302 and the second front lip 304 may be spaced apart approximately along the lateral direction L. Moreover, the first front lip 302 and the second front lip 304 may each extend approximately along the vertical direction V, for example, between the top 104 and the bottom 106 of the case body 300.

Figure 4:
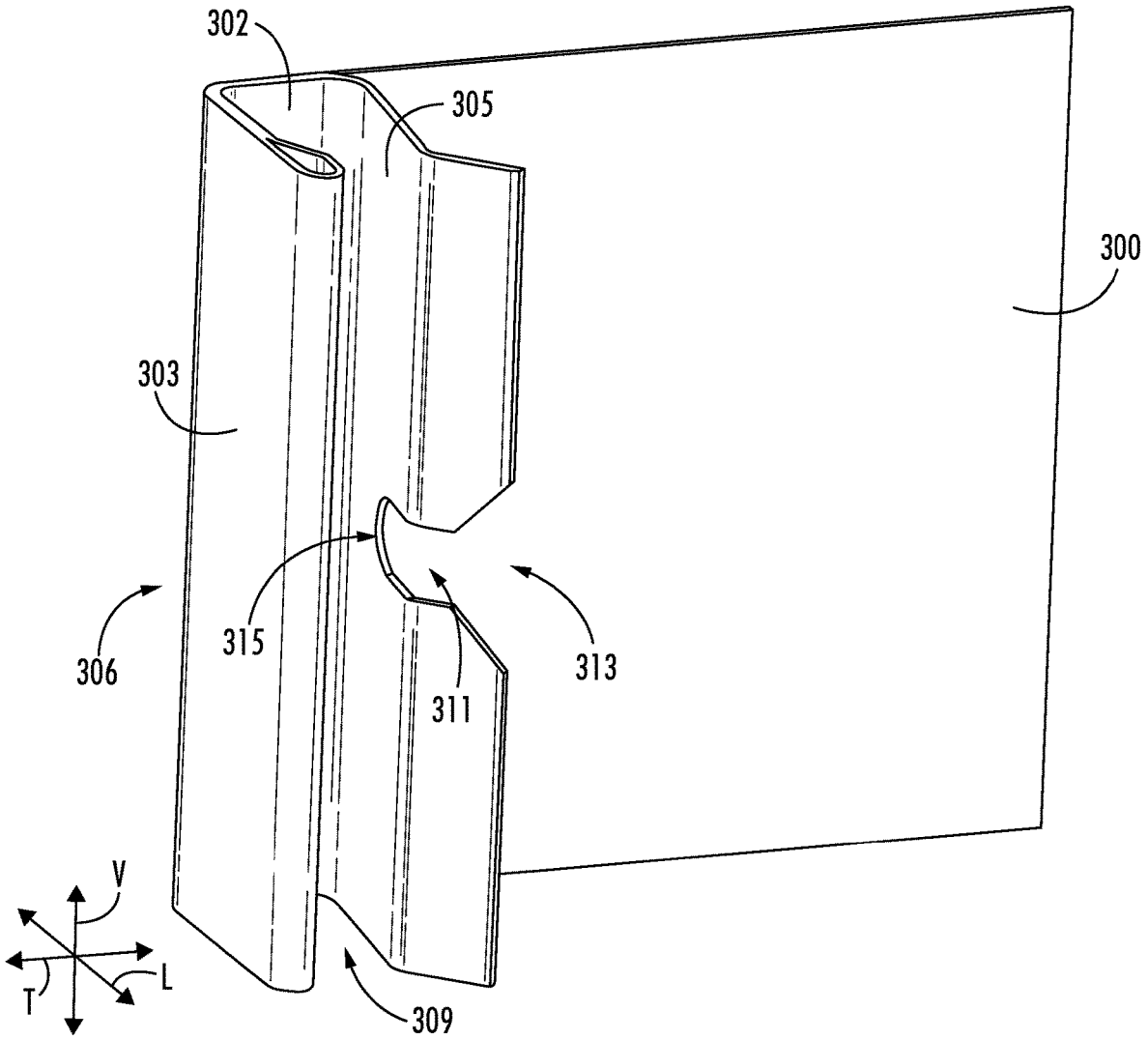
FIG. 4 provides a perspective view of an attachment portion of the case body of FIG. 3 according to one or more exemplary embodiments of the present subject matter.

Referring now to FIG. 4, a perspective view of an attachment portion 307 of the first front lip 302 is provided. Specifically, the attachment portion 307 of the first front lip 302 may be a portion of the first front lip 302 wherein the mullion assembly 350 may be attached. For the sake of brevity and clarity, only the first front lip 302 and the attachment portion 306 of the first front lip 302 is illustrated and generally described herein. One of ordinary skill in the art would clearly understand that the second front lip 304 may include components and features that may be identical to, and may mirror, the components and features of the first front lip 302 described in more detail below. For example, the second front lip 304 may also include an attachment portion 308, see, for example, FIG. 4, positioned at the same height approximately along the vertical direction V as the attachment portion 306 of the first front lip 302.

In some embodiments, the first front lip 302 may include a first outer side 303 and a first bent inner side 305. The first outer side 303 and the first bent inner side 305 may span the entire vertical height of the first front lip 302, for instance, the first outer side 303 and the first bent inner side 305 may extend approximately along the vertical direction V from the bottom 106 of the case body 300 to the top 104 of the case body 300. Furthermore, the first outer side 303 and the first bent inner side 305 may together define a first groove 309 of the first front lip 302.

In some embodiments, the attachment portion 306 of the first front lip 302 may include a first notch 311 defined through the first bent inner side 305. The first notch 311 may extend substantially along the lateral direction L, from an open distal end 313 to a closed proximal end 315. The first outer side 303 may be positioned outward of the first bent inner side 305 approximately along the transverse direction T. For example, the first outer side 303 may be positioned closer to the front 112 of the case body 300 approximately along the transverse direction T than the first bent inner side 305.

Referring now back to FIG. 3, the mullion assembly 350 may generally be attached to the case body 300 at a predetermined height approximately along the vertical direction V, for instance, at the attachment portion 306 of the first front lip 302 and at the attachment portion 308 of the second front lip 304. The predetermined height of the respective attachment portions may correspond to a vertical separation of the one or more chilled chambers of the refrigerator appliance 100, for example, the vertical separation between the fresh food chamber 122 and the freezer chamber 124. The mullion assembly 350 may extend from a first end 352 to a second end 354 approximately along the lateral direction L. For instance, the mullion assembly 350 may generally be attached to the first front lip 302 at the first end 352 and attached to the second front lip 304 at the second end 354.

For the sake of brevity and clarity, only the first end 352 of the mullion assembly 350 and components positioned proximate to the first end 352, for example, closer to the first end 352 than the second end 354 approximately along the lateral direction L, are illustrated and generally described herein. One of ordinary skill in the art would clearly understand that the second end 354 may include components that may be identical to, and may mirror the structure and functions of, the components proximate to, the first end 352.

Figure 5:
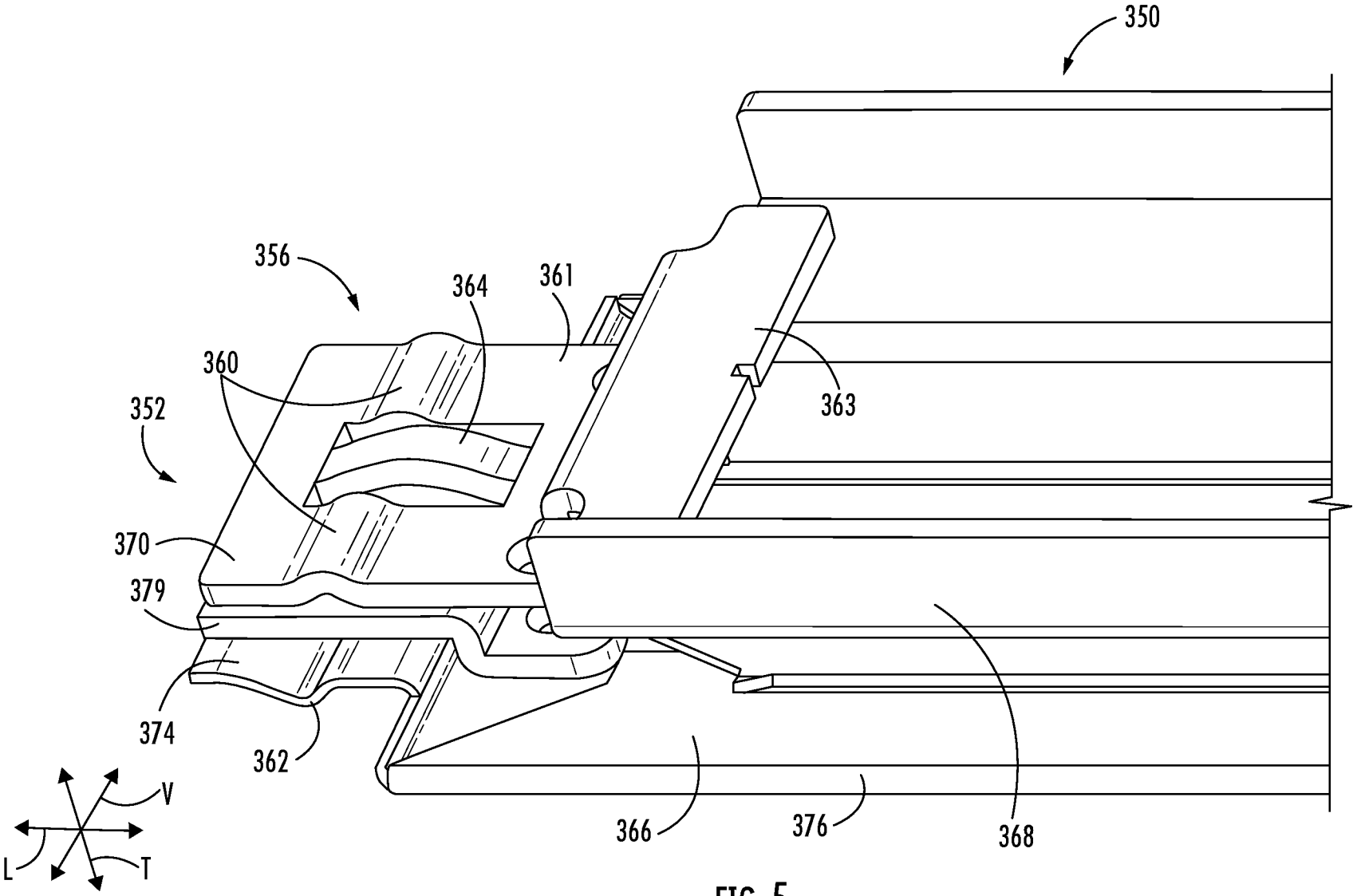
FIG. 5 provides a close-up perspective view of a mullion assembly according to one or more exemplary embodiments of the present subject matter.
Figure 6:
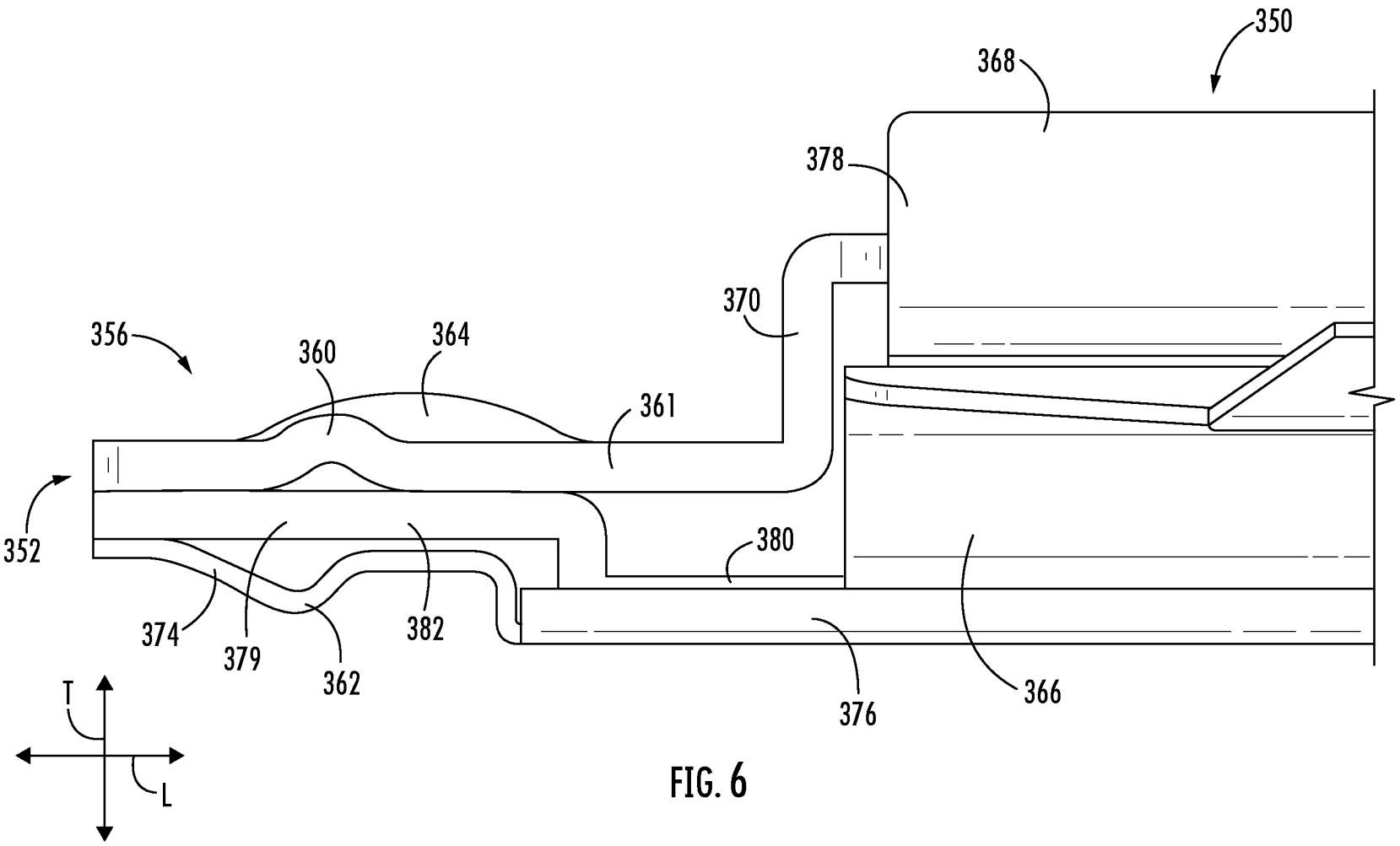
FIG. 6 provides a side view of the mullion assembly of FIG. 5 according to one or more exemplary embodiments of the present subject matter.
Figure 7:
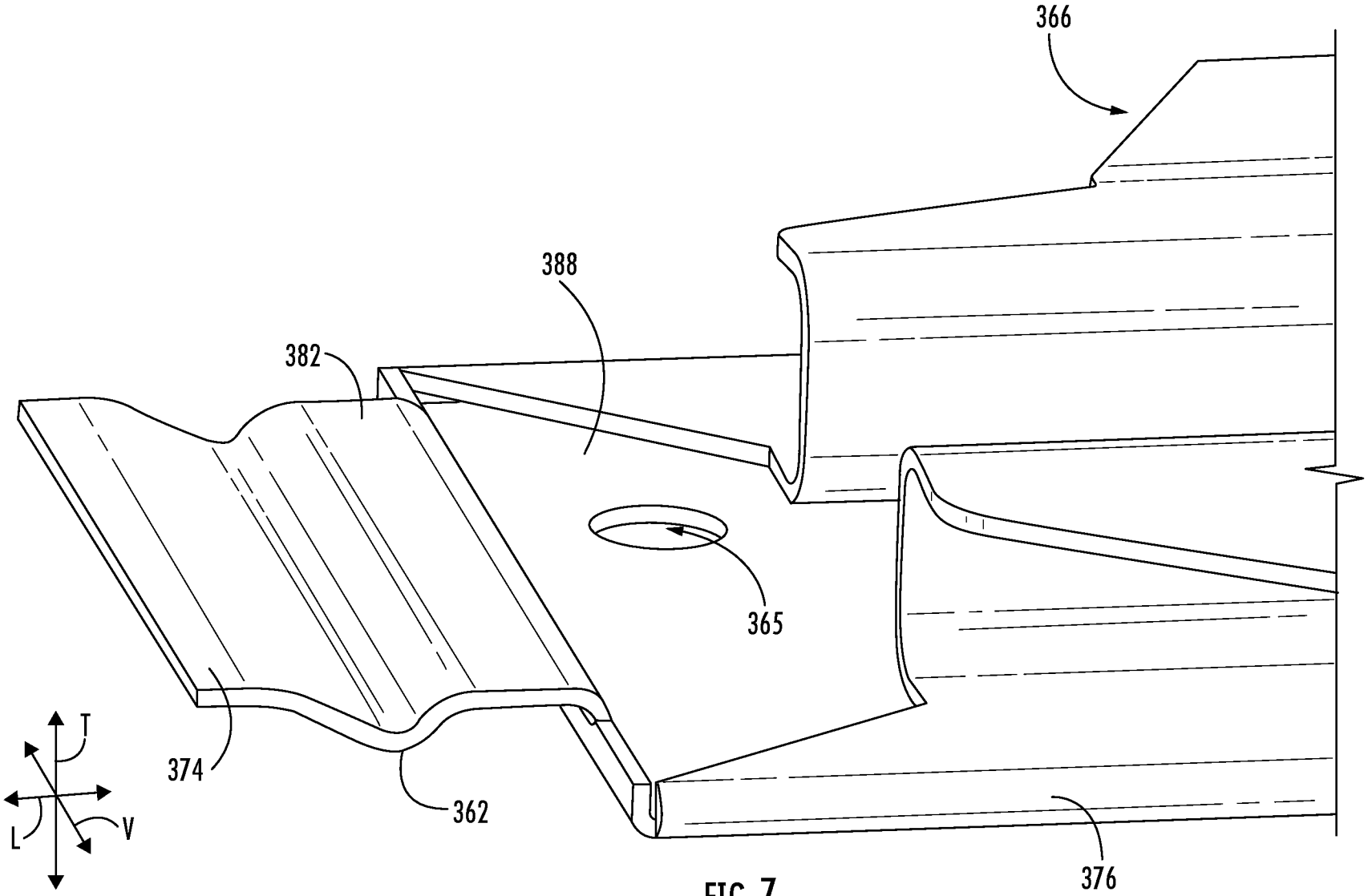
FIG. 7 provides a close-up perspective view of a cosmetic mullion according to one or more exemplary embodiments of the present subject matter.

Referring now to FIGS. 5 and 6, a first flange assembly 356 of the mullion assembly 350 according to one or more exemplary embodiments of the present subject matter is provided. Specifically, FIG. 5 illustrates a perspective view of the first flange assembly 356 and FIG. 6 illustrates a side view off the first flange assembly 356. As illustrated, the first flange assembly 356 may be positioned at, or proximate to, the first end 352 of the mullion assembly 350. As used herein "proximate to the first end 352" may generally refer to a component of the mullion assembly 350 being positioned closer to the first end 352 than the second end 354. As will be described in more detail below, the first front lip 302 may be attached to the first flange assembly 356 by a snap fit provided by the first front lip 302.

Moreover, as illustrated, the first flange assembly 356 may include a first inner bent rib 360, a first outer bent rib 362, and a first lance bridge 364. The first inner bent rib 360 and the first lance bridge 364 may each generally extend approximately along the transverse direction T toward the back 114 of the refrigerator appliance 100, such as when the mullion assembly 350 is attached to the case body 300. Additionally, the first outer bent rib 362 may generally extend approximately along the transverse direction T the front 112 of the refrigerator appliance 100, such as when the mullion assembly 350 is attached to the case body 300.

Referring now to FIGS. 5 through 9, the mullion assembly 350 may include a cosmetic mullion 366, a stiffener 368, and one or more mullion clips, for example, a first mullion clip 370 positioned at the first end 352 of the mullion assembly 350 and a second mullion clip (not depicted) positioned at the second end 354 of the mullion assembly 350. The cosmetic mullion 366 may be provided to improve the appearance of the mullion assembly 350, for instance, when viewed from the front 112 of the refrigerator appliance 100. In addition, the stiffener 368 may be utilized to provide rigidity to the mullion assembly 350.

In some embodiments, the stiffener 368 may be attached to the cosmetic mullion 366, for example, an outer surface of the stiffener 368 may be attached to an inner surface of the cosmetic mullion 366. Furthermore, the first mullion clip 370 may be attached to the stiffener 368, for example, an inner surface of the stiffener 368 may be attached to an outer surface of the first mullion clip 370.

The cosmetic mullion 366 may generally include a first flange 374 positioned at the first end 352 of the mullion assembly 350, a second flange (not depicted) positioned at the second end 354 of the mullion assembly 350, and a main body 376 that may extend between the first flange 374 and the second flange, for example, approximately along the lateral direction L when the mullion assembly 350 is attached to the case body 300. Moreover, the main body 376 of the cosmetic mullion 366 may generally be the main "cosmetic" component of the cosmetic mullion 366, for example, the main body 376 of the cosmetic mullion 366 may be a component of the mullion assembly 350 that may be provided to improve the visual appearance of the mullion assembly 350. Moreover, in some embodiments, the first outer bent rib 362 may be formed integrally in the first flange 374. For instance, the first flange 374 may include the bump, protrusion, or similar raised feature that may generally form the first outer bent rib 362.

The stiffener 368 may generally include a first flange 379 positioned at, or proximate to, the first end 352 of the mullion assembly 350, a second flange (not depicted) positioned at, or proximate to, the second end 354 of the mullion assembly 350, and a main body 378 that may extend between the first flange 379 and the second flange, for example, the main body 378 may extend between the first flange 379 and the second flange 394 approximately along the lateral direction L when the mullion assembly 350 is attached to the case body 300.

Figure 8:
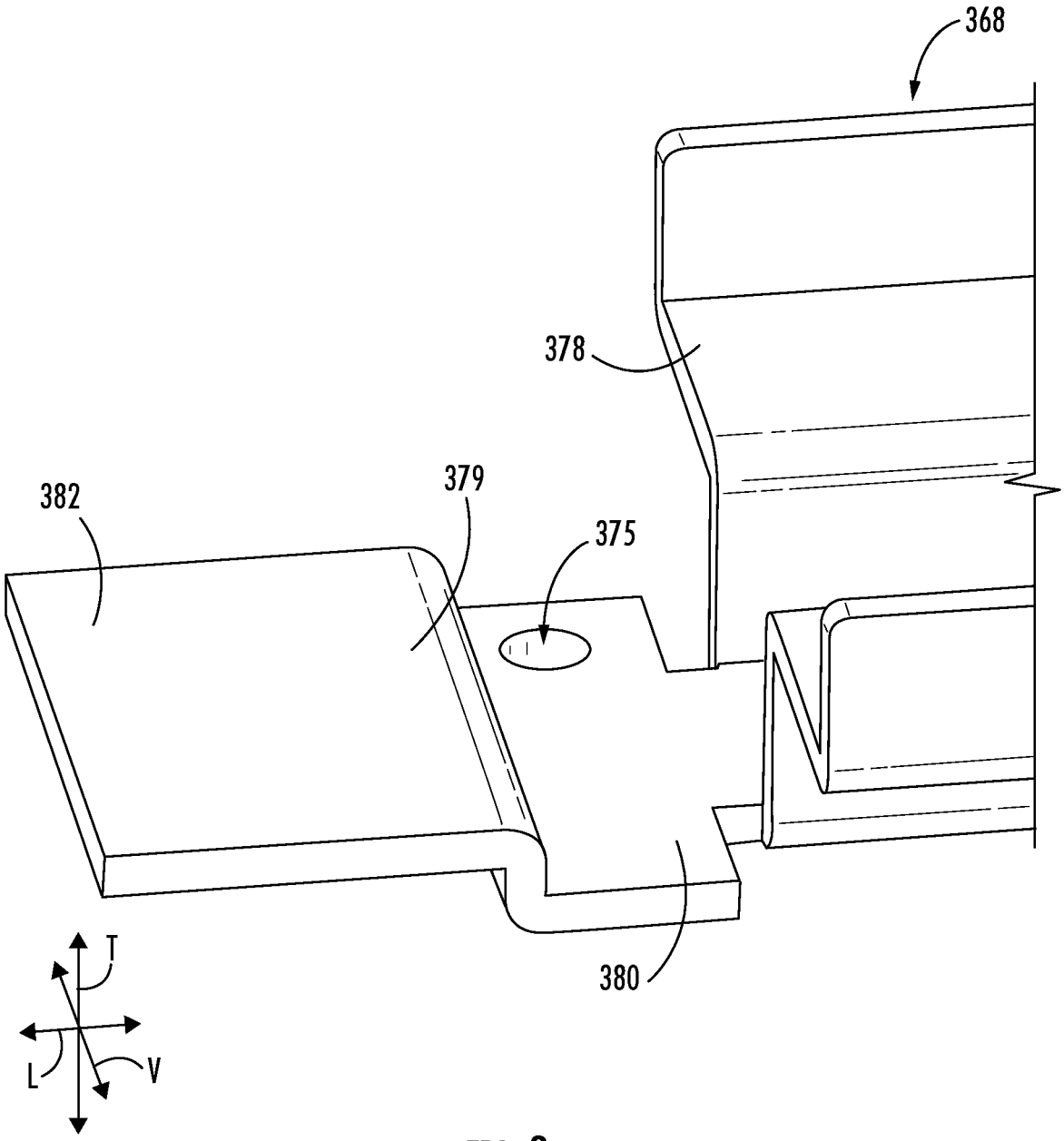
FIG. 8 provides a close-up perspective view of a stiffener according to one or more exemplary embodiments of the present subject matter.
Figure 9:
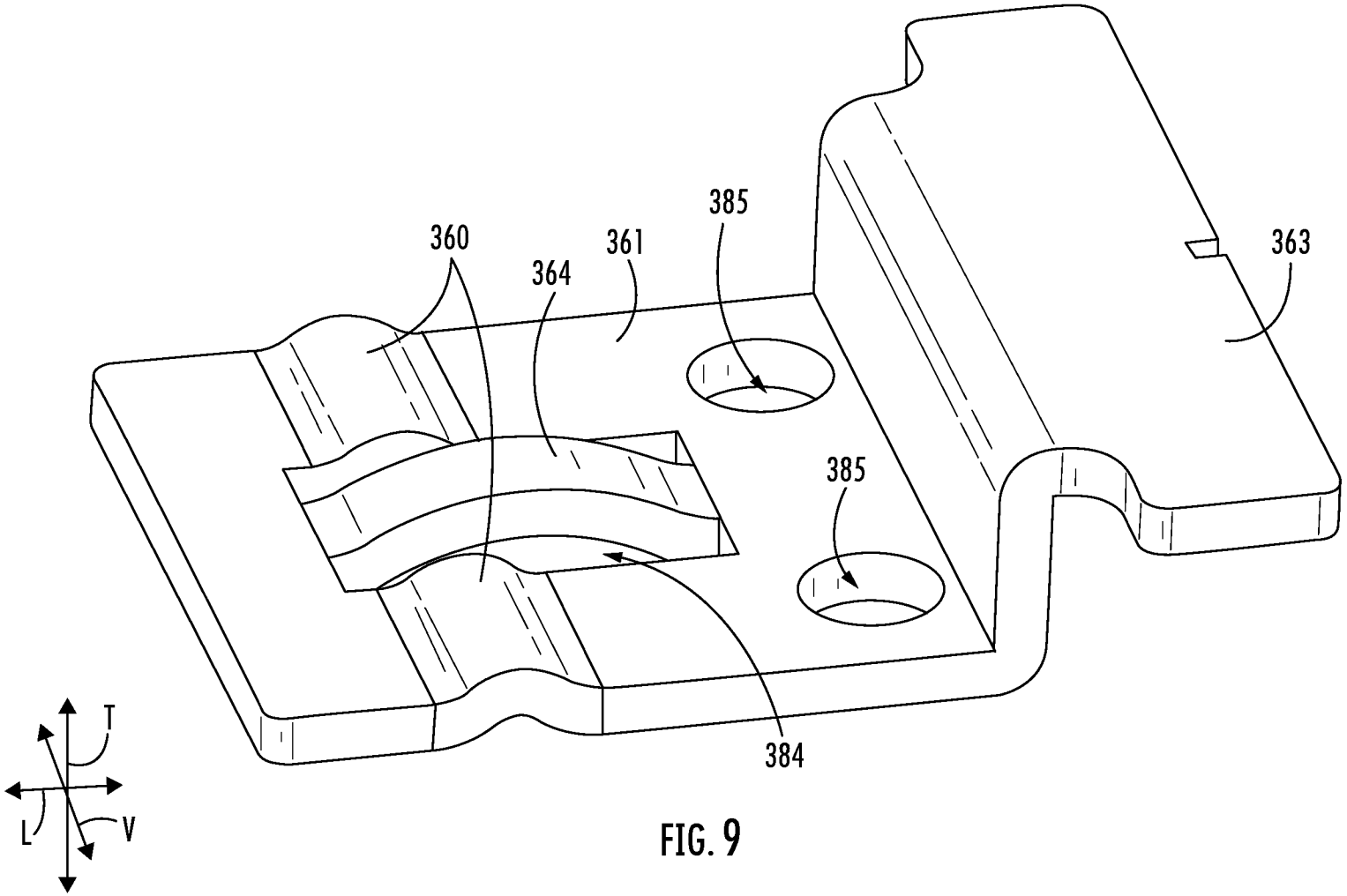
FIG. 9 provides a close-up perspective view of a mullion clip according to one or more exemplary embodiments of the present subject matter.

In addition, in some embodiments, see, for example, FIG. 8, the first flange 379 of the stiffener 368 may include a first portion 380 and a second portion 382. The first portion 380 and the second portion 382 of the first flange 379 may generally be positioned at different depths approximately along the transverse direction T. For example, the first flange 379 may include a double bend that may offset or stagger, the first portion 380 and the second portion 382 such that the first portion 380 and the second portion 382 are at different depths approximately along the transverse direction T. For example, the second portion 382 of the first flange 379 may be positioned such that it may be inward when compared to the first portion 380, such as positioned closer to the back 114 of the refrigerator appliance 100 approximately along the transverse direction T when the mullion assembly 350 is attached to the case body 300.

The mullion clip 370 may include a first flange 361 and an inner portion 363 attached to the first flange 361. The first inner bent rib 360 and the first lance bridge 364 may each be formed integrally into the first flange 361 of the mullion clip 370. Moreover, in some embodiments, see, for example, FIG. 9, the mullion clip 370 may include a slot 384 defined through the first flange 361. In some embodiments, the slot 384 may also be defined through the first inner bent rib 360. Accordingly, the first inner bent rib 360 of the first mullion clip 370 may be a split rib, for example, a non-continuous rib, that may extend approximately along the vertical direction V across the first flange 361. Moreover, the first lance bridge 364 of each mullion clip 370 may span across the length of the slot 384, for example, the distance of the slot as measured approximately along the lateral direction L such as when the mullion assembly 350 is attached to the case body 300.

Furthermore, in some embodiments, the first flange 374 of the cosmetic mullion 366, the first flange 379 of the stiffener, and the first flange 361 of the first mullion clip 370 may together form the first flange assembly 356 of the mullion assembly 350. For instance, in some embodiments, the cosmetic mullion 366 may include a fastener hole 365 that may be positioned proximate the first end 352 and may be defined through the main body 376 of the cosmetic mullion 366, the stiffener 368 may include a fastener hole 365 that may be positioned proximate the first end 352 and may be defined through the first portion 380 of the stiffener 368, and the mullion clip 370 may include one or more fastener holes 385 that each may be positioned proximate the first end 352 and each may be defined through the first flange 361 of the mullion clip 370.

Figure 13:
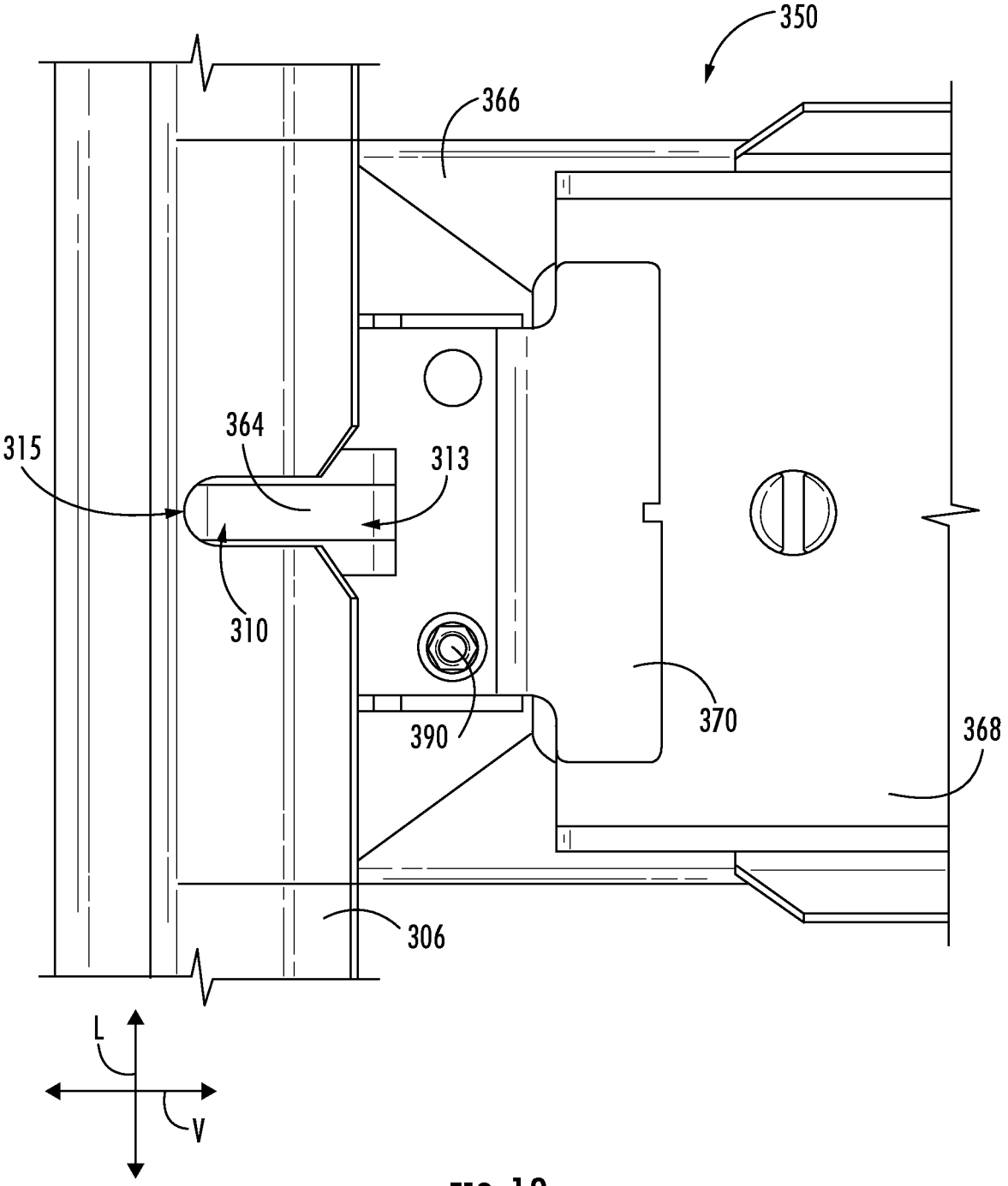
FIG. 13 provides a rear view of a mullion assembly attached to a case body according to one or more exemplary embodiments of the present subject matter.

In some embodiments the fastener hole 365 of the cosmetic mullion 366, the fastener hole 375 of the stiffener 368, and one of the fastener holes 385 of the mullion clip 370 may be concentrically aligned such that a fastener 390, see, for example, FIG. 13, such as a bolt, screw, rivet, or any other suitable mechanical fastener, may be driven through the concentrically aligned fastener holes to mechanically attach the cosmetic mullion 366, the stiffener 368, and the mullion clip 370.

Figure 10:
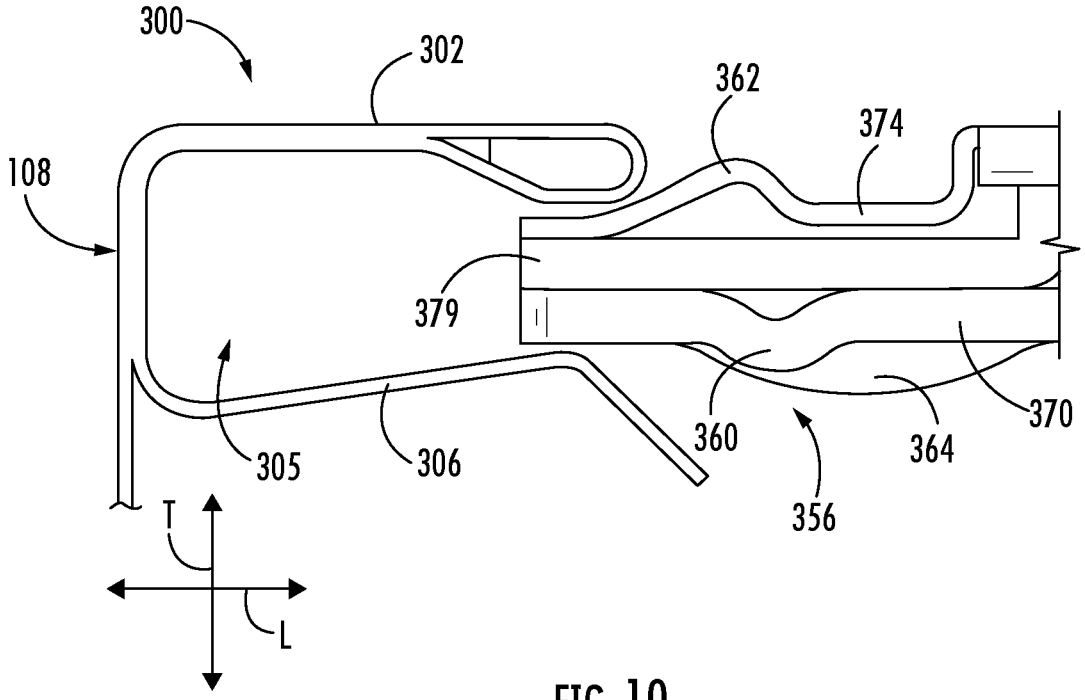
FIG. 10 provides a cross-sectional view of a mullion assembly and a case body according to one or more exemplary embodiments of the present subject matter.
Figure 11:
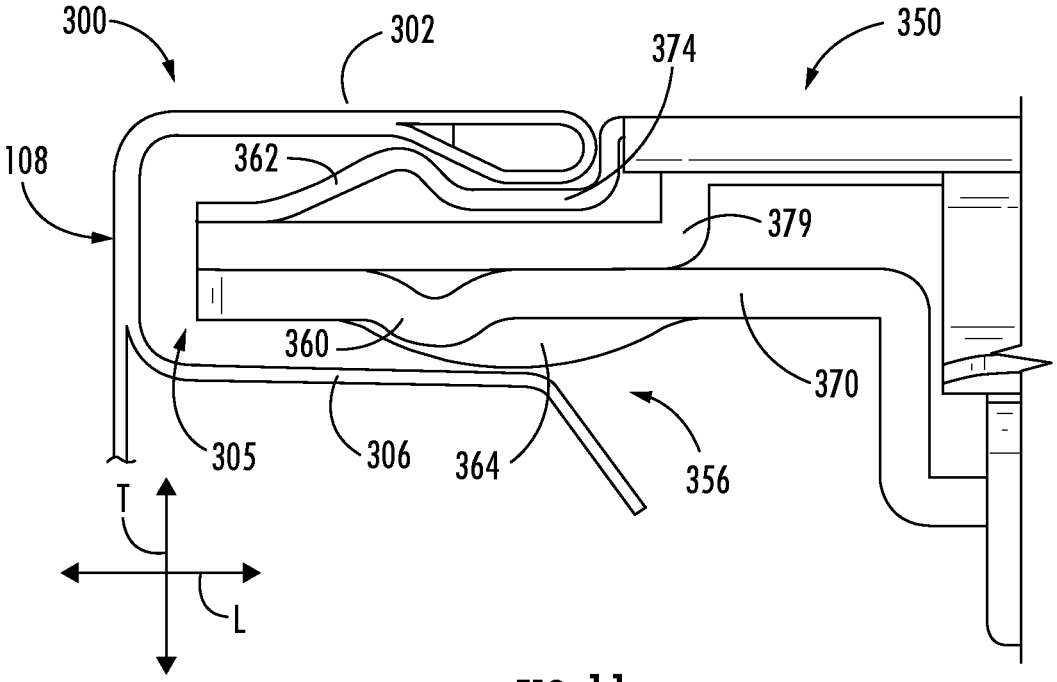
FIG. 11 provides another cross-sectional view of the mullion assembly and the case body according to one or more exemplary embodiments of the present subject matter.
Figure 12:
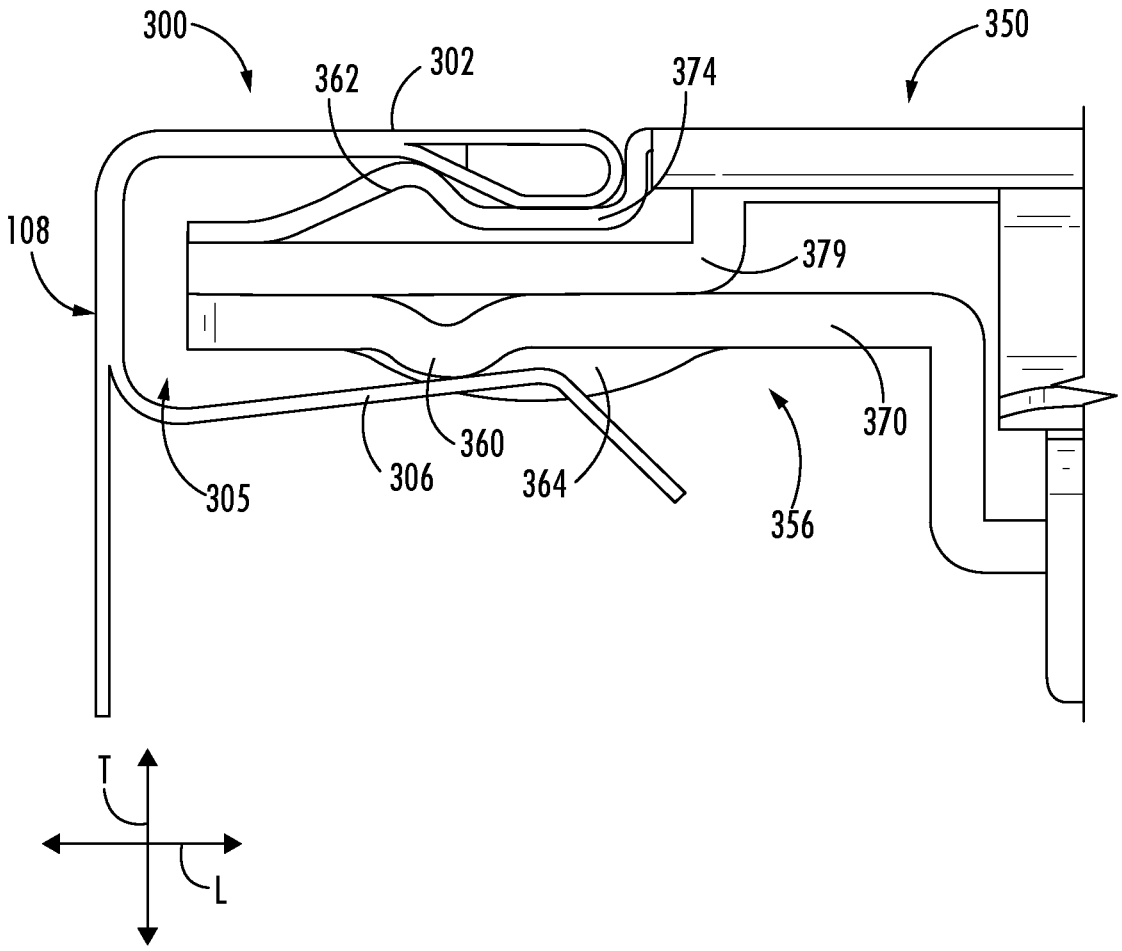
FIG. 12 provides yet another cross-sectional view of the mullion assembly and the case body according to one or more exemplary embodiments of the present subject matter.

Referring now to FIGS. 10 through 12, cross sectional views of the mullion assembly 350 being attached to the case body 300 are provided. Particularly, FIGS. 10 through 12 illustrate the first front lip 302 of the case body 300 being attached to the first flange assembly 356 of the mullion assembly 350. For the sake of brevity and clarity, only the first front lip 302 being attached to the first flange assembly 356 is illustrated and described herein. One of ordinary skill in the art would understand that the second front lip 304 of the case body 300 may be attached to a second flange assembly (not depicted) in an identical manner. Additionally, it would be understood that the attachment of the second flange assembly and the second front lip 304 may substantially mirror the attachment of the first front lip 302 and the first flange assembly 356 illustrated and described herein.

Specifically, as illustrated in FIG. 10, prior to the mullion assembly 350 and the case body 300 being attached, and more particularly, the first flange assembly 356 and the first front lip 302 being attached, the first front lip 302 of the case body 300 may be in an undeflected position, wherein the shape and form of the first front lip 302 are unaltered. For instance, in the undeflected position no force may be applied to the first front lip 302 that may deflect the first front lip 302, and more particularly, that may deflect the first outer side 303 and the first bent inner side 305 approximately along the transverse direction T. In some embodiments, the first front lip 302 may be formed such that the first front lip 302 may be relatively stiff, for example, to maintain the shape and form of the first groove 309 in the undeflected position. For example, in some embodiments, case body 300, and more particularly, the first front lip 302 may be formed by bending a single piece of sheet metal. The first front lip 302 may be biased toward the undeflected position.

Furthermore, as illustrated in FIG. 11, the first flange assembly 356 may be inserted into the first groove 309 of the first front lip 302 to attach the mullion assembly 350 to the case body 300. As the first flange assembly 356 may be inserted into the first groove 309, the first front lip 302 may begin to transition from the undeflected position to a deflected position. The deflected position of the first front lip 302 may be a position of the first front lip 302, wherein the first outer side 303, the first bent inner side 305, or a combination thereof, are deflected approximately along the transverse direction T. For example, in the deflected position, the bent inner side 305 may be deflected the first inner bent rib 360 urging or motivating the bent inner side 305 inward approximately along the transverse direction T. Additionally, in the deflected position, the first outer side 303 of the first front lip 302 may be deflected by the first outer bent rib 362 urging or motivating the first outer side 303 outward approximately along the transverse direction T.

Moreover, as illustrated in FIG. 12, the mullion assembly 350 may be fully attached to the case body 300 by a snap fit. As the first flange assembly 356 is fully inserted into the first groove 309, for example, as the first outer side 303 passes over the first outer bent rib 362 and the first bent inner side 305 over the first inner bent rib 360, the first front lip 302 may "snap" back into place, for example, may transition from the deflected position back to the undeflected position. Particularly, as the first front lip 302 is biased toward the undeflected position, in the deflected position, the first front lip 302 may "snap" back into place by a spring force that may urge the first front lip 302 toward the undeflected position. For instance, as the first outer side 303 passes over the first outer bent rib 362 and the first bent inner side 305 passes over the first inner bent rib 360, the spring force generated by the first front lip 302 may transition the first front lip 302 to the undeflected position such that the first front lip 302 is attached to the first flange assembly 356.

Referring now to FIG. 13, a rear view of the mullion assembly 350 attached to the first front lip 302 is provided. During the attachment of the mullion assembly 350 to the case body 300, the first lance bridge 364 of the mullion clip 370 may be located to the first notch 311 defined by the first bent inner side 305. For instance, the open distal end 313 of the first notch 311 may be flared such that the first lance bridge 364 may easily be located to the first notch 311, for example, such that the first lance bridge 364 may be physically inserted into the first notch 311, as the first notch 311 may not be visible, such as when viewed from the front 112 of the refrigerator appliance 100. Moreover, the open distal end 313 of the first notch 311 may guide the first lance bridge 364 toward the relatively narrow, for example, when compared to the open distal end 313, closed proximal end 315 of the first notch 311.

Once the mullion assembly 350 is fully attached to the case body 300, and more particularly, once the first flange assembly 356 is fully inserted into the first groove 309 and the first lance bridge 364 is fully located to the first notch 311 of the bent inner side 305, the mullion assembly 350 may be fully restrained. In some embodiments, the mullion assembly 350 being "fully restrained" may refer to the mullion assembly 350 being in fixed restraint relative to the case body 300 for all six degrees of freedom of the mullion assembly 350. The six degrees of freedom may be commonly known in the art and may generally refer to the six possible movements that may occur at a point and whether or not these movements are free to move or are restrained. For instance, once the mullion assembly 350 is fully engaged and located to the case body 300, all six degrees of freedom of the mullion assembly 350 may be in fixed restraint in relation to the case body 300. For example, the mullion assembly 350 may be in fixed restraint, for example, may not be free to translate along, or rotate about, the vertical direction V, the lateral direction L, and the transverse direction T, in relation to the case body 300.

Figure 14:
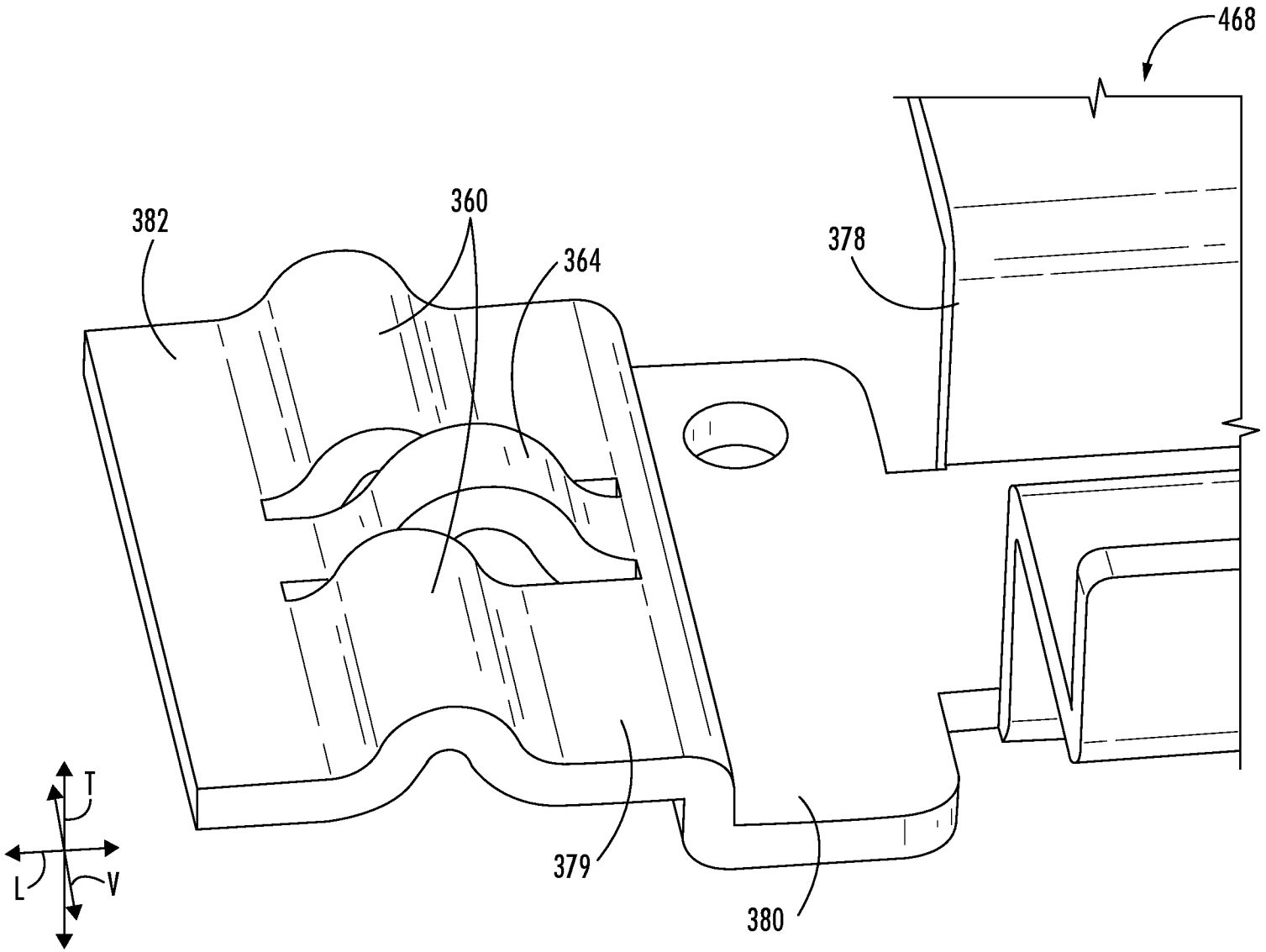
FIG. 14 provides a close-up perspective view of a stiffener according to one or more alternative exemplary embodiments of the present subject matter.

Referring now to FIG. 14, a close-up perspective view of a stiffener 468 according to one or more exemplary aspects of the present disclosure is provided. The exemplary stiffener 468 may be configured in substantially the same manner as the exemplary stiffener of FIG. 8, and accordingly, the same or similar numbers may refer to the same or similar parts.

For example, the exemplary stiffener 468 of FIG. 14 generally include a first flange 379. It should be appreciated that only a first flange 379 of the stiffener 468 is illustrated and described herein for the purpose of brevity and clarity. One of ordinary skill in the art would understand that an identical second flange may be positioned at an opposing end of the stiffener 468 approximately along the lateral direction L. One of ordinary skill in the art would also understand that the identical second flange may mirror the structure and function of the first flange 379.

For instance, the first flange 379 may be positioned at, or proximate to, a first end of a mullion assembly that the stiffener 468 may be incorporated into, for example, the first end 352 of the mullion assembly 350, the second flange (not depicted) may be positioned at, or proximate to, a second end of a mullion assembly that the stiffener 468 may be incorporated into, for example, the second end 354 of the mullion assembly 350, and a main body 378 that may extend between the first flange 379 and the second flange, for example, the main body 378 may extend between the first flange 379 and the second flange approximately along the lateral direction L when the mullion assembly is attached to a case body of the refrigerator appliance, such as when the mullion assembly 350 is attached to the case body 300 of the refrigerator appliance 100.

In addition, the first flange 379 of the stiffener 468 may include a first portion 380 and a second portion 382. The first portion 380 and the second portion 382 of the first flange 379 may generally be positioned at different depths approximately along the transverse direction T. For example, the first flange 379 may include a double bend that may offset or stagger, the first portion 380 and the second portion 382 such that the first portion and the second portion are at different depths approximately along the transverse direction T. The second portion 382 of the first flange 379 may be positioned such that it is back approximately along the transverse direction T when compared to the first portion 380, for example, the second portion 382 may be closer to the back 114 of the refrigerator appliance 100 such as when the mullion assembly is incorporated into refrigerator appliance 100.

However, for the embodiment of FIG. 14, the stiffener 468 is now configured to include the inner bent rib 360 and the first lance bridge 364 of the first flange assembly 356. For instance, the inner bent rib 360 and the first lance bridge 364 may be formed integrally into the second portion 382 of the stiffener 468. Accordingly, when incorporated into a mullion assembly, such as the mullion assembly 350, the stiffener 468 may eliminate the need for the one or more mullion clips 370 as the structure and function of the mullion clip 370 may be integrated into the respective flanges of the stiffener 468.

Embodiments of the present subject matter may advantageously improve a refrigerator appliance, and more particularly, the assembly of the refrigerator appliance, by introducing features that may be used to attach a mullion assembly to a case body of the refrigerator appliance, without the use of screws or fasteners. For instance, the locating features, such as the first notch 311 and the first lance bridge 364, may be utilized to locate the mullion assembly to the case body and the front lip may provide a snap-fit attachment for the mullion assembly. In addition, embodiments of the present subject matter may advantageously improve ergonomics, for example, ergonomics for an operator of the refrigerator appliance, of the assembly of the refrigerator appliance as additional fasteners, for example, screws, are no longer needed to attach the mullion assembly to the case body. Embodiments of present subject matter may also advantageously improve the efficiency of the assembly of the refrigerator appliance and reduce waste that may have been a result of misaligned fasteners.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a case body, the case body comprising a first front lip and a second front lip, the first front lip and the second front lip spaced apart approximately along the lateral direction; and a mullion assembly attached to the case body, the mullion assembly extending from a first end to a second end approximately along the lateral direction, the mullion assembly comprising:

a cosmetic mullion;

a stiffener attached to the cosmetic mullion;

a first mullion clip attached to the stiffener at the first end of the mullion assembly;

a second mullion clip attached to the stiffener at the second end of the mullion assembly;

a first flange assembly positioned at the first end, wherein the first flange assembly is attached to the first front lip by a snap fit; and a second flange assembly positioned at the second end of the mullion assembly, wherein the second flange assembly is attached to the second front lip by a snap fit.

2. The refrigerator appliance of claim 1, wherein the first front lip comprises a first outer side and a first bent inner side, wherein the second front lip comprises a second outer side and a second bent inner side, wherein the first outer side and the first bent inner side together define a first groove, and wherein the second outer side and the second bent inner side together define a second groove.

3. The refrigerator appliance of claim 2, wherein the first front lip comprises a first attachment portion and the second front lip comprises a second attachment portion, wherein the first attachment portion and the second attachment portion are positioned at the same height approximately along the vertical direction.

4. The refrigerator appliance of claim 3, wherein the first attachment portion comprises a first notch defined through the first bent inner side, wherein the first notch extends from an open distal end to a closed proximal end substantially along the lateral direction, wherein the second attachment portion comprises a second notch defined through the second bent inner side, wherein the second notch extends from an open distal end to a closed proximal end substantially along the lateral direction.

5. The refrigerator appliance of claim 1, wherein the first flange assembly comprises a first inner bent rib, a first outer bent rib, and a first lance bridge, and wherein the second flange assembly comprises a second inner bent rib, a second outer bent rib, and a second lance bridge.

6. The refrigerator appliance of claim 1, wherein the cosmetic mullion comprises a first flange, a second flange, and a main body, wherein the stiffener comprises a first flange, a second flange, and a main body, wherein the first flange of the cosmetic mullion, the first flange of the stiffener, and the first mullion clip together form the first flange assembly, and wherein the second flange of the cosmetic mullion, the second flange of the stiffener, and the second mullion clip together from the second flange assembly.

7. The refrigerator appliance of claim 1, wherein the first flange assembly is fully restrained in relation to the case body when the first flange assembly is attached to the first front lip, and wherein the second flange assembly is fully restrained in relation to the case body when the second flange assembly is attached to the second front lip.

8. A refrigerator appliance comprising:

a case body defining a front end, the case body comprising a front lip positioned at the front end; and a mullion assembly comprising:

a cosmetic mullion comprising a flange and a main body, the flange comprising an outer bent rib;

a stiffener comprising a flange and a main body;

a mullion clip comprising an inner bent rib and a lance bridge; and wherein the flange of the cosmetic mullion is attached to the flange of the stiffener, wherein the mullion clip is attached to the flange of the stiffener, wherein the flange of the cosmetic mullion, the flange of the stiffener, and the mullion clip together form a flange assembly, and whereby the flange assembly is attached to the front lip of the case body by a snap fit.

9. The refrigerator appliance of claim 8, wherein the front lip comprises an outer side and a bent inner side, wherein the outer side and the bent inner side together define a groove.

10. The refrigerator appliance of claim 9, wherein during assembly, the outer side and the outer bent rib are interfaced, and the bent inner side and the inner bent rib are interfaced.

11. The refrigerator appliance of claim 9, wherein the front lip comprises an attachment portion, wherein the attachment portion comprises a notch defined through the bent inner side, wherein the notch extends from an open distal end to a closed proximal end.

12. The refrigerator appliance of claim 11, wherein during assembly, the lance bridge of the mullion clip is located to the notch as the flange assembly is attached to the front lip.

13. The refrigerator appliance of claim 9, wherein the front lip is transitionable between an undeflected position and a deflected position, wherein in the deflected position, the outer side and the bent inner side are deflected.

14. The refrigerator appliance of claim 13, wherein during assembly of the refrigerator appliance, front lip is transitioned from the undeflected position to the deflected position as the flange assembly is attached to the front lip.

15. The refrigerator appliance of claim 8, wherein the flange assembly is fully restrained in relation to the case body when the flange assembly is attached to the front lip.

16. A refrigerator appliance comprising:

a case body defining a front end, the case body comprising a front lip positioned at the front end; and a mullion assembly comprising:

a cosmetic mullion comprising a flange and a main body, the flange of the cosmetic mullion comprising an outer bent rib;

a stiffener comprising a flange and a main body, the flange of the stiffener comprising a first portion and a second portion, the second portion comprising an inner bent rib and a lance bridge; and wherein the flange of the cosmetic mullion is attached to the flange of the stiffener, wherein the flange of the cosmetic mullion and the flange of the stiffener together form a flange assembly, and whereby the flange assembly is attached to the front lip of the case body by a snap fit.

17. The refrigerator appliance of claim 16, wherein the front lip comprises an outer side and a bent inner side, wherein the outer side and the bent inner side together define a groove.

18. The refrigerator appliance of claim 17, wherein the front lip comprises an attachment portion, wherein the attachment portion comprises a notch defined through the bent inner side, wherein the notch extends from an open distal end to a closed proximal end.

19. The refrigerator appliance of claim 17, wherein the flange assembly is positioned within the groove, and wherein the flange assembly is fully restrained in relation to the case body when the flange assembly is positioned within the groove.

* * * * *